US005894250A

United States Patent [19]

Ravaska et al.

[11] Patent Number: 5,894,250

[45] Date of Patent: Apr. 13, 1999

[54] CAVITY RESONATOR FILTER STRUCTURE HAVING IMPROVED CAVITY ARRANGEMENT

[75] Inventors: Lasse Beli Ravaska; Kimmo Antero Kyllonen; Guanghua Huang; Lenny Russell Hill, all of Hutchinson, Minn.

[73] Assignee: ADC Solitra, Inc., Hutchinson, Minn.

[21] Appl. No.: 08/821,246

[22] Filed: Mar. 20, 1997

[51] Int. Cl.[6] ..... H01P 5/12; H01P 1/20

[52] U.S. Cl. ..... 333/134; 333/202; 455/562

[58] Field of Search ..... 333/202, 208–212, 333/126, 132, 134; 455/562, 561, 277.1, 103, 107, 111, 115, 117, 226.1, 67.1

[56] References Cited

U.S. PATENT DOCUMENTS

| | | | |
|---|---|---|---|
| 4,291,288 | 9/1981 | Young et al. | 333/212 |
| 4,360,793 | 11/1982 | Rhodes et al. | 333/212 |
| 4,675,630 | 6/1987 | Tang et al. | 333/208 |
| 4,677,402 | 6/1987 | Cesani et al. | 333/212 X |
| 4,780,694 | 10/1988 | Kich et al. | 333/208 |
| 4,881,051 | 11/1989 | Tang et al. | 333/208 |
| 5,530,921 | 6/1996 | Dulong et al. | 333/132 X |
| 5,554,960 | 9/1996 | Ohnuki et al. | 333/132 |

FOREIGN PATENT DOCUMENTS

| | | | |
|---|---|---|---|
| 1050127 | 3/1979 | Canada | 333/212 |
| 467534 | 5/1976 | Russian Federation | 333/134 |
| 467534 | 4/1975 | U.S.S.R. | 333/134 |
| 2 067 848 A | 7/1981 | United Kingdom . | |

OTHER PUBLICATIONS

Mumford, W., "Maximally-flat Filters in Waveguide", *Bell Telephone System Technical Publications*—Monograph B—1602 pp. 1–30 (1948).

Pfitzenmaier, G., "Synthesis and Realization of Narrow-Band Canonical Microwave Bandpass Filters Exhibiting Linear Phase and Transmission Zeros", *IEEE Transactions on Microwave and Theory Techniques*, 30(9):1300–1311 (Sep. 1982).

Uwano, T., "Ceramic-filled Resonator Cuts Costs of Radio-Telephone Filters", *Electronics International*, 56(14):129–131 (Jul. 1983).

Liang, Ji-Fuh et al., "Mixed Modes Dielectric Resonator Filters", IEEE Transactions on Microwave Theory and Techniques, vol. 42, No. 12, pp. 2449–2454, Dec., 1994.

Wang, Chi et al., "Mixed Modes Cylindrical Planar Dielectric Resonator Filters with Rectangular Enclosure", IEEE Transactions on Microwave Theory and Techniques, vol. 43, No. 12, pp. 2817–2823, Dec., 1995.

Solitra Oy Brochure, "Short Company Info", Kempele, Finland prior to Mar. 1997.

Solitra Product Brochure, "Duplexfilter for the 450MHZ Handportable / NXS4401", May 8, 1995.

Solitra Oy Product Brochure "Duplexer for the 450 MHZ Handportable / NSX4501", May 8, 1995.

Solitra Oy Product Brochure "EGSM Duplex Filter / GXS9504", May 8, 1995.

Solitra Product Brochure "Low-Pass Filter / PXP8101", Sep. 20, 1995.

Solitra Product Brochure "Microcell Filter, PCS 1900 Series I / PXU9201", Sep. 20, 1995.

*Primary Examiner*—Seungsook Ham

*Attorney, Agent, or Firm*—Merchant, Gould, Smith, Edell, Welter & Schmidt, P.A.

[57] ABSTRACT

A combined resonator-cavity filter includes a number of cavity structures designed for cooperative arrangement within a housing. The resonator cavities are constructed and arranged to pass energy in an assigned frequency band. The cavities include a first cavity structure having a corresponding cavity volume and constructed to provide a first Q, and a second cavity structure having its corresponding cavity volume and constructed to provide a second Q. The cavity volume corresponding to the second cavity structure is less than the cavity volume corresponding to the first cavity structure. Other aspects are directed to the arrangement and uses of sets of such cavity structures as part of a combined duplexer-receiver having the same housing.

15 Claims, 3 Drawing Sheets

CAVITY RESONATOR FILTER STRUCTURE HAVING IMPROVED CAVITY ARRANGEMENT

FIELD OF THE INVENTION

The present invention relates generally to structures and techniques for filtering radio waves, and, more particularly, the implementation of such filters using resonator cavities.

BACKGROUND OF THE INVENTION

Radio frequency (RF) equipment has used a variety of approaches and structures for receiving and transmitting radio waves in the selected frequency bands. The type of filtering structure used is often dependent upon the intended use and the specifications for the radio equipment. For example, dielectric filters are often used for filtering electromagnetic energy in the ultra-high frequency band, such as those used for cellular communications in the 800+ MHz frequency range. Typically, such filter structures are implemented by coupling a number of dielectric resonator structures together. Coaxial resonators in such filters are coupled together via capacitors, strip transmission lines, transformers, or by apertures in walls separating the resonator structures. The number of resonator structures used for any particular application is also dependent upon the system specifications and, typically, added performance is realized by increasing the number of intercoupled resonator structures.

There has been an increasing demand with such intercoupled resonator structures, as with almost all electric or electronic devices and equipment, to reduce both the size and cost of the equipment. Unlike electronic devices that have been significantly miniaturized due to advances in semiconductor technology, efforts to downsize and cost-reduce RF equipment have been inhibited. This is often due to the inherent size of each resonator structure used in an overall RF filter, by specification demands which dictate an increasing number of resonator structures per filter function and a zero latitude in the number of filters required in the RF systems.

Accordingly, there has been a need for a filter which overcomes the above-mentioned and other disadvantages associated with the prior art.

SUMMARY OF THE INVENTION

According to one embodiment, the present invention is directed to a cavity-resonator filter in a housing. The filter comprises: a set of resonator cavities, which are constructed and arranged to pass energy through at least one assigned band, including a first cavity structure having a corresponding cavity volume and constructed to provide a first Q and including a second cavity structure having a corresponding cavity volume and constructed to provide second Q. The cavity volume corresponding to the second cavity structure is less than the cavity volume corresponding to the first cavity structure.

According to another embodiment, the present invention is directed to a combined resonator-cavity filter in a housing structure. The filter comprises of three sets of resonator cavities, each set of resonator cavities being constructed and arranged to pass energy in one of three respectively-assigned bands. Further, each set includes at least one upper Q cavity having a corresponding cavity volume and at least one lower Q cavity having a corresponding cavity volume that is less than the volume corresponding to the upper Q cavity. Two of the three sets of resonator cavities are arranged to pass energy in a receive radio mode, and the other of the three sets of resonator cavities is arranged to pass energy in a radio-transmit mode.

According to another embodiment, the present invention is directed to a combined duplexer-receive filter in a housing structure, as described above, and further including a pair of low-noise amplifiers respectively coupled to the two sets of resonator cavities. According to more specific embodiments, the low-noise amplifiers are arranged in discrete compartments within the single housing structure. The first low-noise amplifier may be arranged in a first compartment on one side of the housing structure, and the second low-noise amplifier may be arranged in a compartment opposite the first compartment.

Another more specific embodiment of an aspect of the present invention is directed to a combined duplexer-receive filter in a housing structure including three sets of resonator cavities and at least one test coupler for testing the operation of the filters. Each set of resonator cavities is constructed and arranged to pass energy in one of three respectively assigned frequency bands, two of the three sets of resonator cavities arranged to pass energy in a receive signal mode, and the other of the three sets of resonator cavities arranged to pass energy in a transmit signal mode. A first low-noise amplifier is coupled to one of said two sets of resonator cavities; and a second low-noise amplifier coupled to one of said two sets of resonator cavities. The first and second low-noise amplifiers are arranged in discrete compartments opposite one another within the housing structure. The housing structure includes a port connecting power and status signals to each of the first and second low-noise amplifiers, and includes a coupler cavity coupling energy between a transmit test port and the other of the three sets of resonator cavities arranged to pass energy in a transmit signal mode and between a receive test port and the one of the two sets of resonator cavities arranged to pass energy in a receive signal mode.

The above summary is not intended to summarize each aspect or advantage of the disclosed embodiments. This is the purpose of the detailed description and drawings.

BRIEF DESCRIPTION OF THE DRAWINGS

Other aspects and advantages of the invention will become apparent upon reading the following detailed description and upon reference to the drawings in which.

Figure 1:
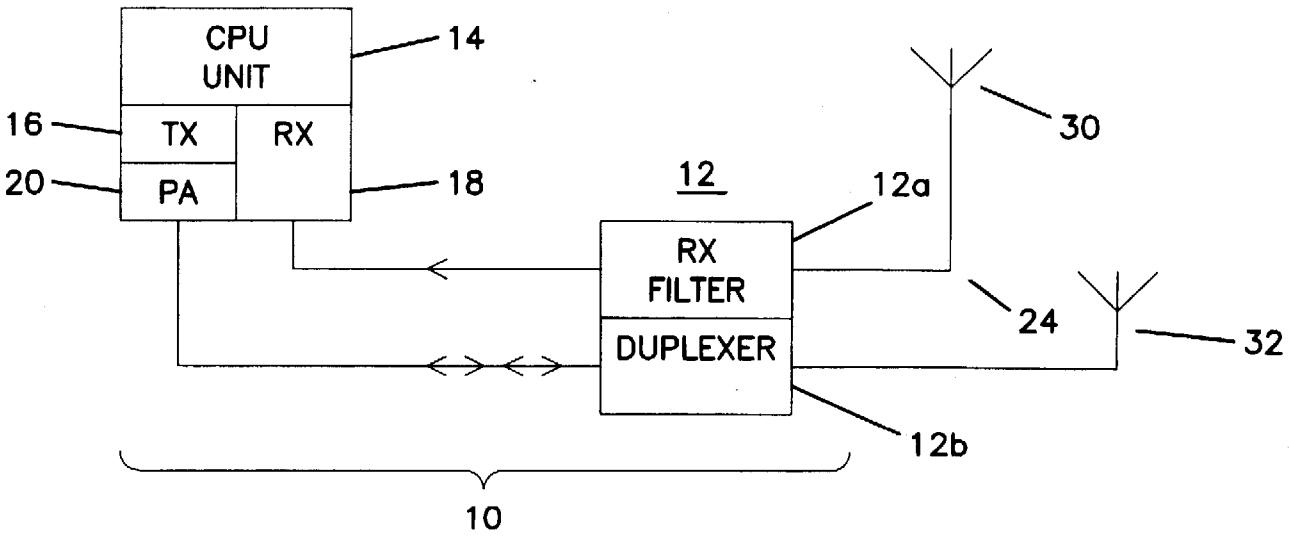
FIG. 1 is an illustration of a communications system incorporating a combined duplexer/receive-filter product according to one embodiment of the present invention.

While the invention is susceptible to various modifications and alternative forms, specific embodiments thereof have been shown by way of example in the drawings and will herein be described in detail. It should be understood, however, that the detailed description is not intended to limit the invention to the particular forms disclosed. On the contrary, the intention is to cover all modifications, equivalents, and alternatives falling within the spirit and scope of the invention as defined by the appended claims.

DETAILED DESCRIPTION

The present invention is believed to be applicable to a variety of radio frequency (RF) applications in which achieving low insertion loss in the passband with high attenuation in the stopband close to the passband is desirable and/or where there is little room for locating radio equipment. The present invention has been found to be particularly applicable and beneficial for PCS-CDMA base stations, cellular-communication base stations, and other duplex-communication applications. While the present invention is not so limited, an appreciation of the present invention is best presented by way of a particular example application, in this instance, in the context of such a communication system.

Turning now to the drawings, FIG. 1 illustrates a base station 10, according to a particular application and embodiment of the present invention, including a housing 12 having a receiver 12*a* for diversity-antenna 30 and a duplexer 12*b* for antenna 32. The radio 10 is depicted generally, so as to represent a wide variety of arrangements and constructions. The illustrated radio 10 includes a CPU-based central control unit 14, audio and data signal processing circuitry 16 and 18 for the respective transmit and receive signaling, and a power amplifier 20 for the transmit signaling.

According to a general embodiment of the present invention for an application requiring low insertion loss, a set of resonator cavities is specially constructed to provide a compact filter structure for use, for example, in filtering energy in designated passbands for the receiver 12*a* and the duplexer 12*b*. The set of resonator cavities are constructed and arranged to pass energy in at least one assigned frequency band. The set includes a first cavity structure having a corresponding cavity volume and providing a first Q, and a second cavity structure having a corresponding cavity volume and providing a second Q. The cavity volume corresponding to the second cavity structure is less than the cavity volume corresponding to the first cavity structure. By increasing the volume of at least one of the cavities in the filter, the Q of the filter is increased to provide a significantly reduced insertion loss.

Where it is advantageous to include more than one such set of resonator cavities in the same housing structure, the present invention can play an important role. In the housing 12 of FIG. 1, for instance, one set of resonator cavities may be included to implement the receive filter 12*a*, and two other sets may be included to implement the respective transmit and receive filter sections of the duplexer 12*b*. In this manner, the various cavity sizes may be arranged with respect to one another to optimize the compactness of the housing.

Figure 2:
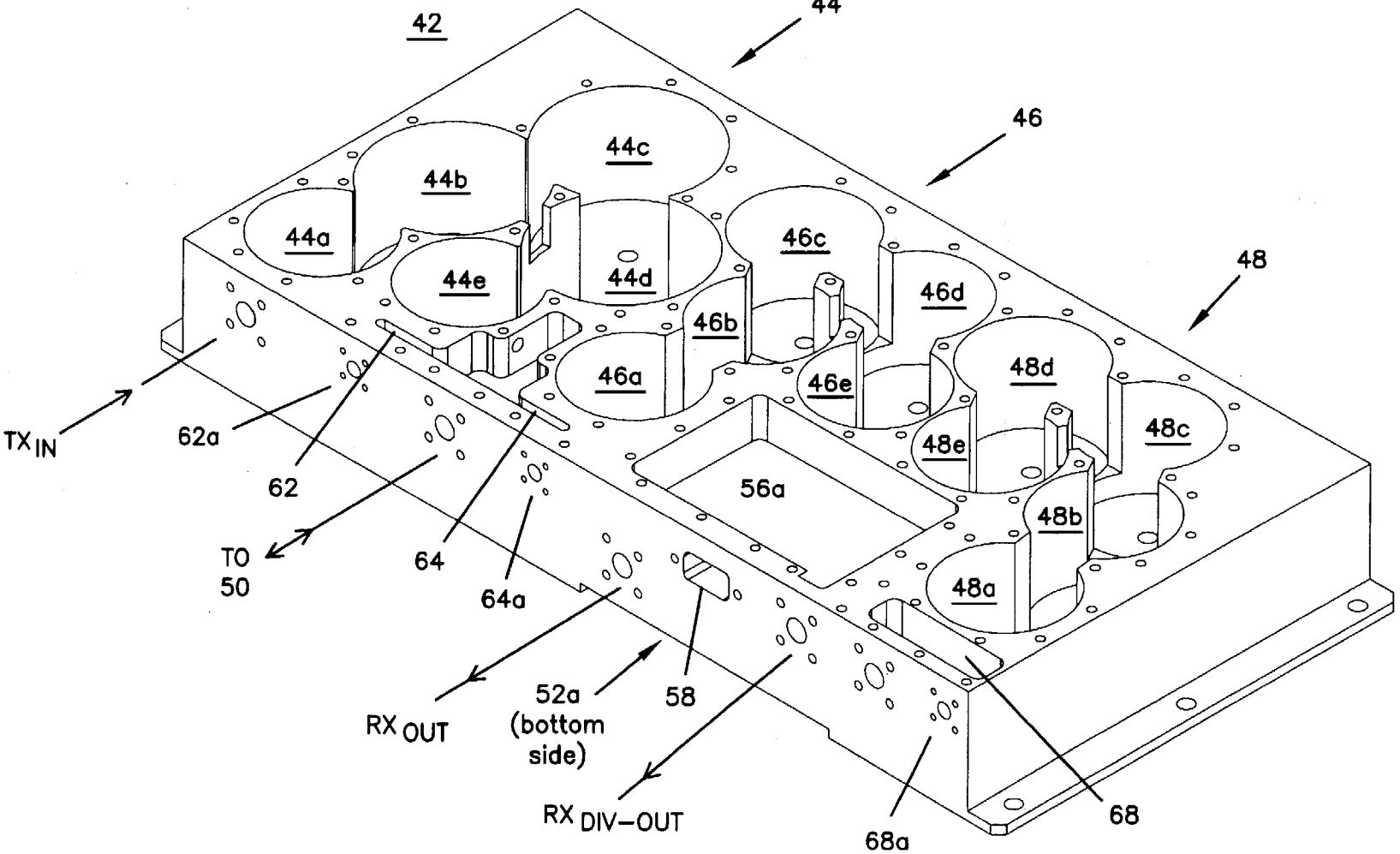
FIG. 2 is a perspective view of a duplexer/receive-filter, according to another embodiment of the present invention.

According to a specific embodiment of the present invention, FIG. 2 illustrates a perspective view (top plate removed) of a duplexer/receive-filter 40 implemented in a relatively compact single housing 42. The filter 40 includes three filters, each implemented as a set of five intercoupled resonator cavities. The filters are depicted generally as 44, 46 and 48, and the individual cavities of each set are specifically depicted as 44*a*–44*e*, 46*a*–46*e* and 48*a*–48*e*, respectively.

Figure 3:
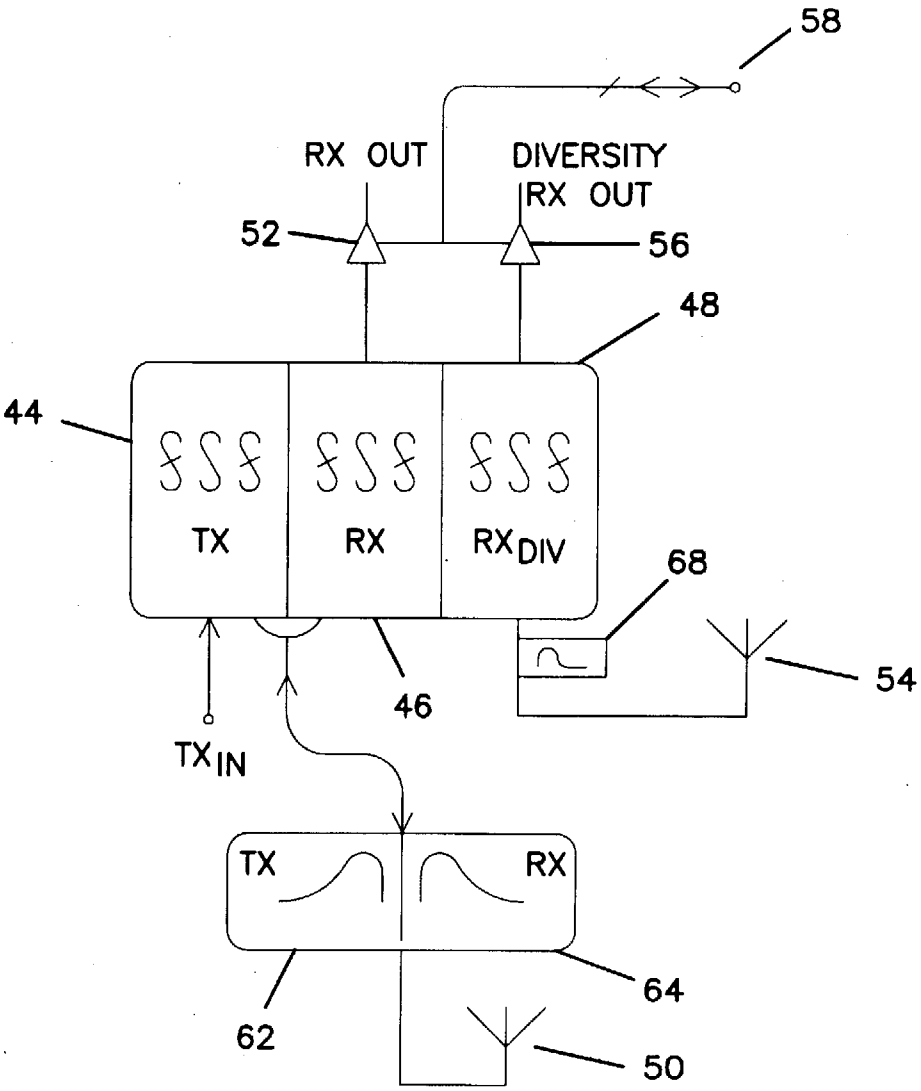
FIG. 3 is a schematic diagram of the duplexer/receive-filter of FIG. 2.

As shown in the schematic diagram of FIG. 3, the first filter 44 corresponds to the transmit filter of the duplexer section of the housing 42. This filter 44 receives energy from the transmit section of a radio, for example, from a power amplifier such as disclosed in FIG. 1, and filters the energy according to a designated transmit-frequency passband. From the filter 44, filtered energy is coupled to the radio antenna 50 for transmission.

The second filter 46 corresponds to the receive filter of the duplexer section of the housing 42. This filter 46 receives energy from the radio antenna 50 and filters the energy according to a designated receive-frequency passband. From the filter 46, filtered receive energy is coupled to a first low-noise amplifier 52 before being processed any further by the radio.

The third filter 48 is for filtering signals received by the diversity-antenna 54, according to a designated receive-frequency passband associated with the diversity antenna 54. From the filter 48, filtered receive energy is coupled to a second low-noise amplifier 56 before being processed by the radio.

The first and second low-noise amplifiers 52 and 56 may be powered and monitored, e.g., for status and alarm conditions, using conventional wiring coupled to the housing via a suitable connector 58, such as a D-connector. In a specific embodiment, each low-noise amplifier includes an amplifier and a current-failure alarm circuit for monitoring current to the amplifier. A D-connector interconnects to each low-noise amplifier, regulated power for powering the amplifier and the output signal of the current-failure alarm circuit, which is used to monitor the condition of the corresponding low-noise amplifier.

The housing 42 also contains transmit and receive directional couplers at 62 and 64 which may be coupled to probes at ports 62*a* and 64*a* for conventional testing purposes. Similarly, a receive directional coupler at 68 may be coupled to a test probe at port 68*a*. In each of these illustrated coupler compartments, a conventional microstrip (or other suitable) circuit may be secured.

Another important aspect of this latter embodiment of the present invention is arranging and sizing the individual cavities, along with the other disclosed structures, so that the housing 42 can provide the necessary filtering functions in a relatively compact area. As illustrated in FIG. 2, some of the cavities are larger than other cavities. For example, the filter 44 includes three large-size cavities 44*b*, 44*c* and 44*d* and two small-size cavities 44*a* and 44*e*. From an electrical vantage point, while the order of the relative sizes is not critical, the larger-sized cavities provide a higher Q than the smaller-sized cavities. Collectively, the Q's of the respective cavities provide a sufficient reduction in insertion loss to meet relatively stringent design specifications. From a real-estate perspective, by including large-size and small-size cavities, the location of the cavities can be important in ensuring that each of the illustrated structures fits in the housing without exceeding space limitations.

Another important aspect of the embodiment illustrated in FIG. 2 concerns the locations of the low-noise amplifiers 52 and 56 and the test coupler 64. The low-noise amplifiers 52 and 56 are respectively located as conventionally-constructed circuits placed in cavities 52*a* and 56*a*. The circuit for the low-noise amplifier 52 is secured on the bottom side (not shown in FIG. 2) of the housing 42 and located directly opposite and arranged substantially in the same manner as the cavity 56*a* on the top side of the housing 42. The housing 42, which may be constructed from aluminum, includes a wall separating the two amplifiers.

Each set of resonator cavities is implemented using conventional bandpass filtering techniques, for example, each as coaxial resonator having a center conductor projecting upward from the bottom of the housing 42 toward the top plate.

The dimensions used to implement the multiple-filter structure can vary and largely depend upon the filtering specifications dictated for the equipment and type of communication being serviced. In a specific embodiment directed to a PCS-CDMA base station, insertion-loss can be substantially lessened using larger volumes for cavities 44b and 44c. For example, assuming a common cavity depth of 40 millimeters, the cavities 44b and 44c can be implemented using a diameter of roughly 58 millimeters, and the remaining cavities implemented using a diameter of roughly 45 millimeters. The housing 42, with the above-listed example cavity dimensions, can be implemented with dimensions (roughly) as follows: 42 millimeters thick (excluding the top plate); 317 millimeters long (excluding the mounting extensions on each end); and 158 millimeters wide. This structure can be used, for example, to provide filtering for a PCS-CDMA base station operating in the 1900 MHz range.

Other aspects and embodiments of the present invention will be apparent to those skilled in the art from consideration of the specification and practice of the invention disclosed herein. For example, the housing illustrated in FIG. 2 may be implemented with fewer or more than the three illustrated filters, and the disclosed selection of cavity number and cavity size can vary according to design specifications. It is intended that the specification and illustrated embodiments be considered as exemplary only, with a true scope and spirit of the invention being indicated by the following claims.

What is claimed is:

1. A combined duplexer-receive filter in a housing structure, comprising three independent sets of resonator cavities, each set of resonator cavities constructed and arranged to pass energy in one of three respectively assigned bands and each set including at least one upper Q cavity having a corresponding cavity volume and at least one lower Q cavity having a corresponding cavity volume that is less than the volume corresponding to the upper Q cavity, two of the three sets of resonator cavities arranged to pass energy in a radio receive mode, and the other of the three sets of resonator cavities arranged to pass energy in a radio transmit mode.

2. A combined duplexer-receive filter in a housing structure, comprising: three independent sets of resonator cavities, each set of resonator cavities constructed and arranged to pass energy in one of three respectively assigned bands and each set including at least one upper Q cavity having a corresponding cavity volume and at least one lower Q cavity having a corresponding cavity volume that is less than the volume corresponding to the upper Q cavity, two of the three sets of resonator cavities arranged to pass energy in a receive signal mode, and the other of the three sets of resonator cavities arranged to pass energy in a transmit signal mode; a first low-noise amplifier coupled to one of said two sets of resonator cavities; and a second low-noise amplifier coupled to the remaining one of said two sets of resonator cavities; wherein the first low-noise amplifier is arranged in a first compartment on one side of the housing structure and the second low-noise amplifier is arranged in a compartment opposite the first compartment.

3. A combined duplexer-receiver filter, according to claim 2, further including a test coupler coupling respective transmit and receive test probes to said other of the three sets of resonator cavities and to said one of said two of the three sets of resonator cavities.

4. A combined duplexer-receive filter, according to claim 2, further including a test coupler coupling respective transmit and receive test probes to said other of the three sets of resonator cavities and to said one of said two of the three sets of resonator cavities.

5. A combined duplexer-receive filter, according to claim 4, further including a test coupler coupling a receive test probe to said other of said two of the three sets of resonator cavities.

6. A combined duplexer-receive filter in a housing structure, comprising: three independent sets of resonator cavities, each set of resonator cavities constructed and arranged to pass energy in one of three respectively assigned frequency bands, two of the three sets of resonator cavities arranged to pass energy in a receive signal mode, and the other of the three sets of resonator cavities arranged to pass energy in a transmit signal mode; a first low-noise amplifier coupled to one of said two sets of resonator cavities; and a second low-noise amplifier coupled to the remaining one of said two sets of resonator cavities; the first and second low-noise amplifiers arranged in discrete compartments opposite one another within the housing structure.

7. A combined duplexer-receive filter, according to claim 6, wherein the housing structure includes a port for connecting power signals for at least one of the low-noise amplifiers.

8. A combined duplexer-receive filter, according to claim 6, wherein the housing structure includes a port connecting power signals commonly shared by each of the first and second low-noise amplifiers.

9. A combined duplexer-receive filter, according to claim 6, wherein the housing structure includes a port for connecting power and status signals for at least one of the low-noise amplifiers.

10. A combined duplexer-receive filter in a housing structure, comprising: three sets of resonator cavities, each set of resonator cavities constructed and arranged to pass energy in one of three respectively assigned frequency bands, two of the three sets of resonator cavities arranged to pass energy in a receive signal mode, and the other of the three sets of resonator cavities arranged to pass energy in a transmit signal mode; a first low-noise amplifier coupled to one of said two sets of resonator cavities; a second low-noise amplifier coupled to the remaining one of said two sets of resonator cavities; the first and second low-noise amplifiers arranged in discrete compartments opposite one another within the housing structure; the housing structure including a port connecting power and status signals to each of the first and second low-noise amplifiers, and including a coupler cavity coupling energy between a transmit test port and the other of the three sets of resonator cavities arranged to pass energy in a transmit signal mode and between a receive test port and the one of the two sets of resonator cavities arranged to pass energy in a receive signal mode.

11. A combined duplexer-receive filter in a housing structure, according to claim 10, the housing further including a coupler coupling energy between a second receive test port and the remaining one of the two sets of resonator cavities arranged to pass energy in a receive signal mode.

12. A combined duplexer-receive filter in a housing structure, according to claim 11, wherein the other of the three sets of resonator cavities arranged to pass energy in a transmit signal mode is constructed and arranged to pass energy with a lower insertion loss than the two sets of resonator cavities arranged to pass energy in a receive signal mode.

13. A combined duplexer-receive filter in a housing structure, according to claim 12, wherein the other of the three sets of resonator cavities arranged to pass energy in a transmit signal mode provides the lower insertion loss as a function of cavity size.

14. A combined duplexer-receive filter in a housing structure, according to claim 13, wherein the other of the three sets of resonator cavities arranged to pass energy in a transmit signal mode includes not more than six cavities and not less than four cavities.

15. A combined duplexer-receive filter in a housing structure, according to claim 14, wherein the other of the three sets of resonator cavities arranged to pass energy in a transmit signal mode includes at least a first cavity having a first volume and a second cavity having a second volume, the first volume being greater than the second volume.

* * * * *